US009849575B2

(12) United States Patent
Costoli et al.

(10) Patent No.: US 9,849,575 B2
(45) Date of Patent: Dec. 26, 2017

(54) PNEUMATIC SCREWER

(75) Inventors: Mario Costoli, Casina (IT); Antonio Spagnolo, Reggio Emilia (IT)

(73) Assignee: Dino Paoli S.r.l. (IT)

( * ) Notice: Subject to any disclaimer, the term of this patent is extended or adjusted under 35 U.S.C. 154(b) by 1104 days.

(21) Appl. No.: 13/979,237

(22) PCT Filed: Jan. 17, 2012

(86) PCT No.: PCT/IB2012/050217

§ 371 (c)(1),
(2), (4) Date: Sep. 27, 2013

(87) PCT Pub. No.: WO2012/098496

PCT Pub. Date: Jul. 26, 2012

(65) Prior Publication Data

US 2014/0014387 A1 Jan. 16, 2014

(30) Foreign Application Priority Data

Jan. 18, 2011 (IT) ..... MO2011A0006
Jan. 18, 2011 (IT) ..... MO2011A0007

(51) Int. Cl.
*B25F 5/02* (2006.01)
*B25F 5/00* (2006.01)
*B25B 21/00* (2006.01)

(52) U.S. Cl.
CPC ..... *B25F 5/00* (2013.01); *B25B 21/00* (2013.01)

(58) Field of Classification Search
CPC ..... B25F 5/00; B25B 21/00
(Continued)

(56) References Cited

U.S. PATENT DOCUMENTS 2,950,775 A 8/1960 Zwayer
3,823,795 A * 7/1974 Fleigle ..... B25B 21/02 173/DIG. 2

(Continued)

FOREIGN PATENT DOCUMENTS

CN 201586966 U * 9/2010 ..... B23Q 5/00
DE 102005046485 A1 3/2007
WO 2009012228 A2 1/2009

*Primary Examiner* — Andrew M Tecco
(74) *Attorney, Agent, or Firm* — Laubscher, Spendlove & Laubscher, P.C.

(57) ABSTRACT

A pneumatic screwing device includes a spindle for rotatably supporting a screwing tool, a pneumatically drivable rotor for rotating the spindle and a stator for housing the rotor. A gap is defined between the rotor and the stator to receive pressurized air and a supply conduit in the stator delivers pressurized air to the gap. Discharge conduits in the stator discharge pressurized air from the gap. In order to make the pneumatic screwing device more efficient than known devices, there is provided an expansion chamber in communication with the discharge conduits for expanding the pressurized air, the expansion chamber being positioned on an opposite side of the spindle with respect to the rotor and being in communication with the atmosphere. A switch for switching a screwing direction of the pneumatic screwing device includes seats arranged for engaging with locking elements that are slidably associated with the screwing device for maintaining the switch in an operating position corresponding to a desired screwing direction of the device. In order to make the switch more reliable and easier to handle, three seats are provided that are arranged in sequence, the locking elements engaging in the operating position with two of the three seats.

14 Claims, 7 Drawing Sheets

(58) Field of Classification Search
USPC ..... 173/168, 169, 218
See application file for complete search history.

(56) References Cited

U.S. PATENT DOCUMENTS

| | | | | | |
|---|---|---|---|---|---|
| 3,901,631 | A * | 8/1975 | Wickham | F01C 21/10 | 418/270 |
| 4,061,158 | A * | 12/1977 | Musial | B60R 25/042 | 137/384.4 |
| 4,869,680 | A * | 9/1989 | Yamamoto | H01R 12/7005 | 211/41.17 |
| 5,346,024 | A * | 9/1994 | Geiger | B25F 5/001 | 173/221 |
| 6,164,387 | A * | 12/2000 | Chang | B25F 5/00 | 173/169 |
| 7,354,260 | B1 * | 4/2008 | Chang | F01C 1/3442 | 173/200 |
| 2006/0278416 | A1 | 12/2006 | Tanji | | |
| 2008/0264662 | A1 | 10/2008 | Chang | | |
| 2009/0020003 | A1 | 1/2009 | Chen | | |
| 2011/0186315 | A1 * | 8/2011 | Li | B23Q 5/00 | 173/16 |

* cited by examiner

PNEUMATIC SCREWER

This application is a §371 National Stage Entry of PCT International Application No. PCT/IB2012/050217 filed on Jan. 17, 2012. PCT/IB2012/050217 claims priority to IT Applications Nos. MO2011A000006 filed on Jan. 18, 2011 and MO2011A000007 filed on Jan. 18, 2011. The entire contents of these applications are incorporated herein by reference.

The invention relates to a pneumatic screwer.

The invention further relates to a switch for switching a screwing direction of a pneumatic screwer.

Pneumatic screwers are known that comprise a spindle for rotatably supporting a screwing tool.

Such screwers are further provided with a rotor that is pneumatically rotatable.

The rotor, which is connected mechanically to the spindle, rotates the latter.

The rotor includes a cylindrical body having a circular section.

The cylindrical body is provided peripherally with seats, arranged radially and angularly spaced apart from one another, inside which respective blades are slidable.

Known screwers further comprise a stator, which is internally hollow, for housing the rotor.

Between the rotor and the stator a gap is defined that is arranged for receiving pressurised air.

The rotor is mounted eccentrically with respect to the stator in such a manner that the blades cooperate with an internal wall of the stator for defining, in the gap, chambers, the volume of which varies during rotation of the rotor.

Each chamber is defined between two circumferally consecutive blades, the rotor and the internal wall of the stator.

A supply conduit for delivering pressurised air to the gap, a primary discharge conduit and a secondary discharge conduit for discharging the pressurised air from the gap are obtained in the stator.

The primary discharge conduit is obtained in an upper zone of the stator corresponding to the maximum distance between the rotor and the stator.

More precisely, the primary discharge conduit is in a zone of the screwer opposite a further zone of the screwer from which a handle of the screwer extends.

The supply conduit and the secondary discharge conduit are obtained in further zones of the stator arranged symmetrically with respect to a plane passing through a rotation axis of the rotor and comprising the primary discharge conduit.

This enables the screwers to be driven in opposite rotation directions by simply exchanging, by a switch, the functions of the supply conduit and of the secondary discharge conduit. More precisely, by means of the switch it is possible to deliver pressurised air into the gap alternatively via the supply conduit or the secondary discharge conduit, and consequently to discharge pressurised air from the gap respectively via the secondary discharge conduit or the supply conduit.

The switch comprises a cylindrical element that is slidable in the screwer between an operating position in which the screwer acts with a screwing direction and a further operating position in which the screwer acts with a further screwing direction.

On the cylindrical element a first seat and a second seat are obtained that are arranged for engaging respectively with a first locking element and with a second locking element slidably associated with the screwer for positioning the switch respectively in the operating position or in the further operating position.

In particular, in the operating position the first locking element engages the first seat whereas the second locking element is disengaged from the second seat, and in the further operating position the second locking element engages the second seat whereas the first locking element is disengaged from the first seat.

The first and the second locking element are maintained pressed against the first seat and the second seat by respectively a first spring and a second spring, the stiffness of which is adjustable by respective adjusting screws.

Switches are further known in which a single locking element is provided that is alternatively engageable in the first seat or in the second seat.

In use, at the start of an operating cycle, the pressurised air is introduced via the supply conduit inside a chamber that is initially of reduced volume, i.e. positioned near a zone in which the rotor is nearer the stator.

Forces act on the blades that define the chamber, which forces tend to drive the rotor in opposite directions.

The prevailing force is the force that acts on the blade that protrudes the most from the respective seat.

The resultant of the aforesaid forces produces a driving torque on the rotor.

Subsequently, a portion of air contained in this chamber, which is already partially expanded, is expelled directly into the atmosphere via the primary discharge conduit.

This pressurised air can nevertheless, given the position of the primary discharge conduit, hit the operator using the screwer, disturbing the operator during use of the screwer.

Still subsequently, following a further rotation of the rotor, a remaining portion of air contained inside this chamber is expelled via the secondary discharge conduit and conveyed towards the outside of the screwer via a conveying conduit, positioned in and extending over the entire length of the handle of the screwer.

This pressurised air is thus unable to expand completely as it is "strangled" by the path defined by the conveying conduit, this reducing the performance of the screwer.

A drawback of known switches is that they are not much reliable and safe because they have difficulty to maintain a desired operating position.

In other words, in use, the switch, owing to the force exerted by the pressurised air circulating in the screwer, moves autonomously from the operating position to the further operating position and vice versa.

In order to overcome this drawback, it is common practice to stiffen significantly the springs of the locking elements.

Nevertheless, this solution is not satisfactory inasmuch as it greatly compromises the handling of the switch.

An object of the invention is to improve pneumatic screwers.

A further object is to provide pneumatic screwers that are more efficient than known screwers.

A still further object is to improve switches arranged for switching a screwing direction of a pneumatic screwer.

Another further object is to provide switches arranged for switching a screwing direction of a pneumatic screwer that are more reliable and easier to handle than known switches.

The invention provides a pneumatic screwer, as defined in the independent claim 1.

The screwer according to the invention is more efficient than known screwers.

In fact, the discharge conduit is in flowing communication with said expansion chamber, which is positioned on an opposite side of the spindle with respect to the rotor and is in flowing communication with the atmosphere.

This enables said pressurised air to reduce the path to be made to expand completely, as it no longer needs to cover the entire handle of the screwer, which enables the performance of the screwer according to the invention to be improved.

The invention further provides a switch as defined in independent claim 11.

The switch according to the invention is more reliable and manoeuvrable than known switches.

In fact, experimental results have shown that when in the operating position the locking device engages two of the three seats and effectively maintains the switch in the operating position and at the same time ensures easy handling.

The invention can be better understood and implemented with reference to the attached Figures, which illustrate some embodiments thereof by way of non-limiting example, in which.

Figure 1:
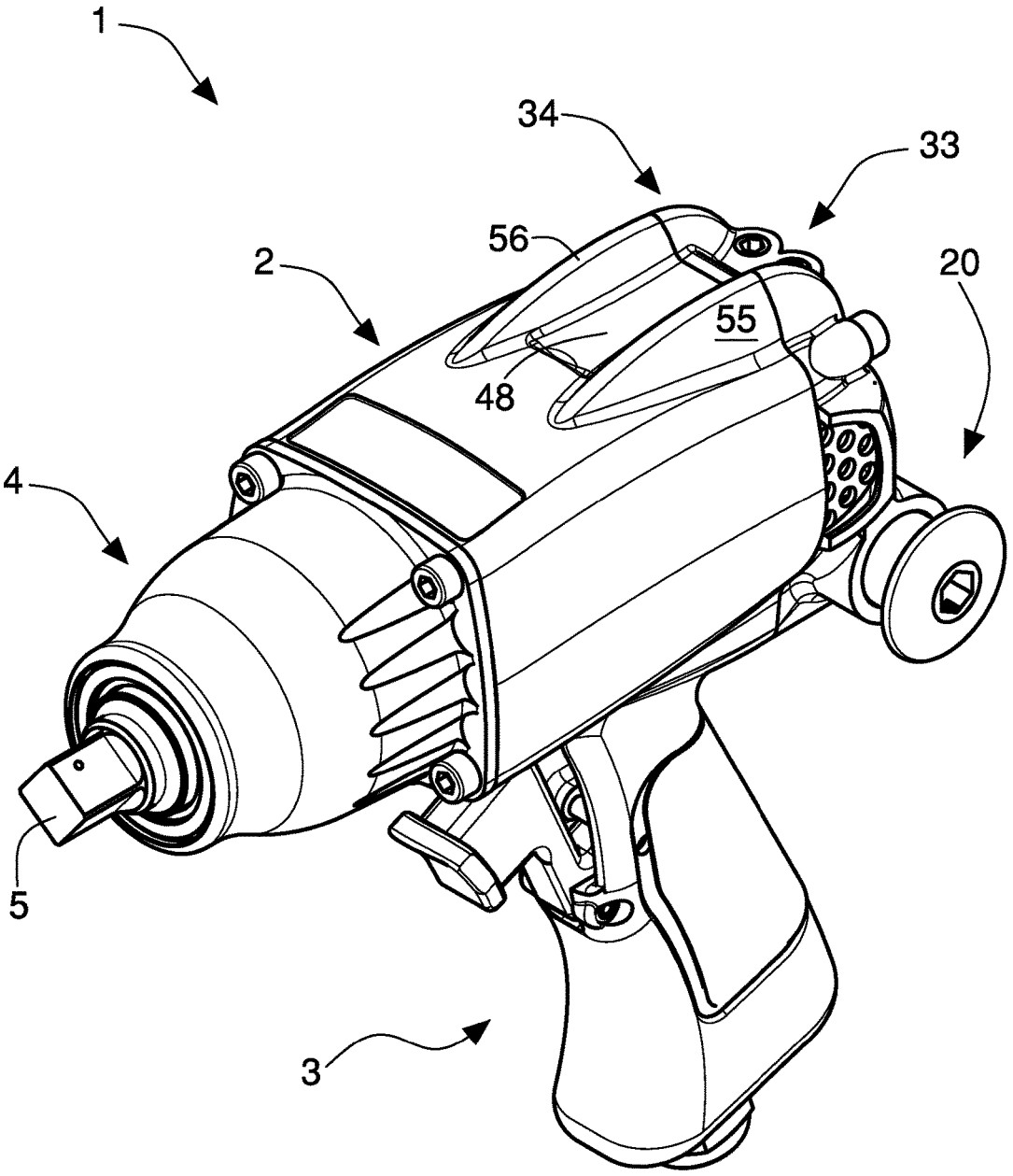
FIG. 1 is a perspective view of a pneumatic screwer.

With reference to FIG. 1 there is shown a pneumatic screwer 1.

The pneumatic screwer 1 comprises a main body 2 and a handle 3 projecting from the main body 2.

The pneumatic screwer 1 further includes a spindle element 5 projecting from a first end portion 4 of the main body 2 and arranged for rotatably supporting a screwing tool, which is not shown.

Figure 3:
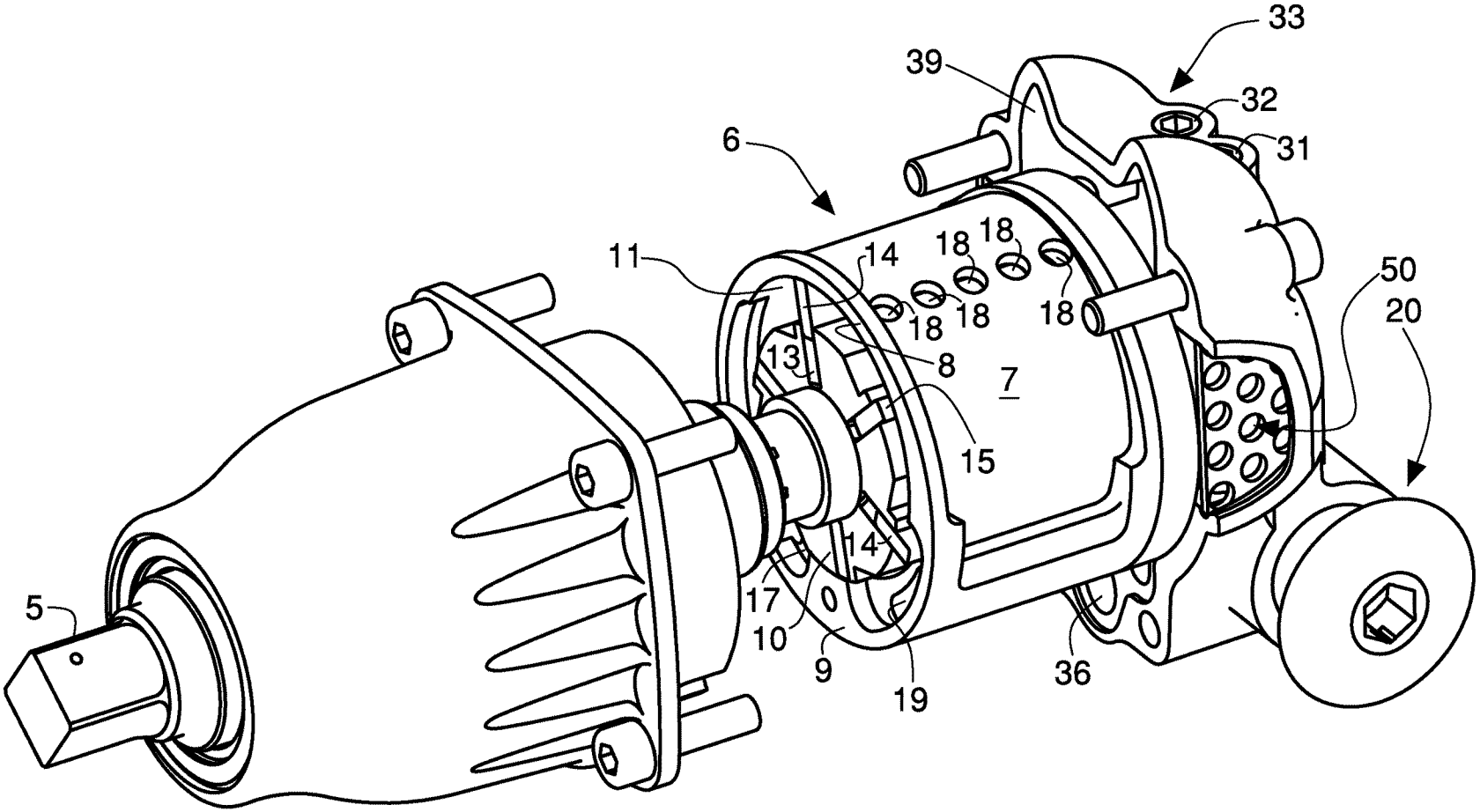
FIG. 3 is a perspective view, with some details removed, of the screwer in FIG. 1.
Figure 5:
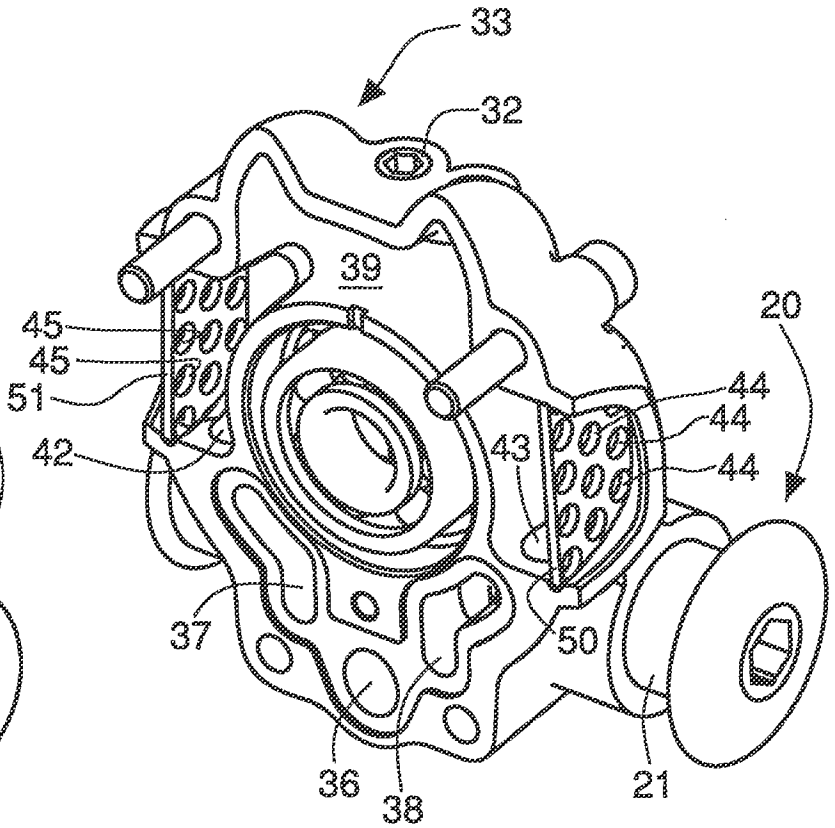
FIGS. 4 and 5 are perspective views of some details of the screwer in FIG. 1.
Figure 6:
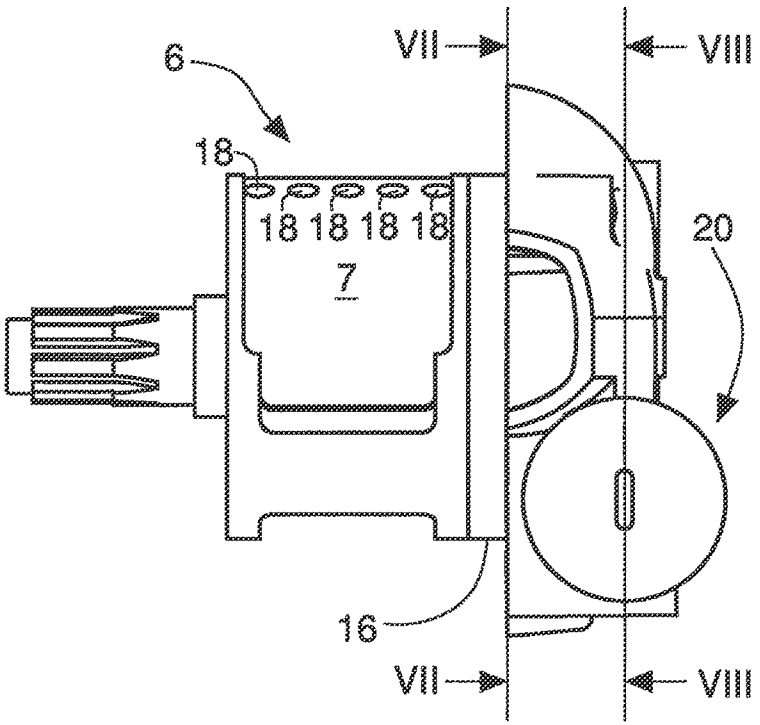
FIG. 6 is a side view of part of a pneumatic motor included in the screwer in FIG. 1.

The pneumatic screwer 1 further comprises a pneumatic motor 6, shown in FIGS. 3 and 6.

The pneumatic motor 6 comprises a stator 7 having a cylindrical shape.

The stator 7 which is internally hollow has a variable thickness, which in particular increases from an upper portion 8 to a lower portion 9 thereof.

The pneumatic motor 6 further comprises a rotor 10 that is pneumatically rotatable.

The rotor 10, which is connected mechanically to the spindle element 5, rotates the latter.

The rotor 10 is housed inside the stator 7, between the rotor 10 and the stator 7 a gap 11 being defined that is arranged, as will be disclosed better below, for receiving pressurised air.

The rotor 10 has a cylindrical shape with a substantially circular section.

The rotor 10 is rotatably coupled with the stator 7 in such a manner as to be rotatable around a rotation axis that is eccentric in relation to a longitudinal axis of the stator 7. In the rotor 10, radial seats 13 are obtained externally, in each of which a blade 14 is slidable.

The radial seats 13 are mutually angularly equidistant and shaped in such a manner as to each receive a blade 14.

The blades 14 are, for example, made of carbon fibre and are arranged for being struck by an operating fluid, in particular pressurised air, arranged for rotating the rotor 10.

Each blade 14 is radially slidable inside the respective seat 13, in such a manner as to be movable between a compact configuration, in which the blade 14 is contained completely inside the seat 13, and an extended configuration, in which the blade 14 projects outside the seat 13.

The blade 14 is positioned in the compact configuration when the respective seat 13 is in the point of minimum distance from an internal wall of the stator 7 facing the seat.

On the other hand, the blade 14 is positioned in the extended configuration when the respective seat 13 is at the point of maximum distance from the aforesaid internal wall.

During rotation of the rotor 10, an end 15 of each blade 14 is maintained in contact with the internal wall of the stator 7, in such a manner that two circumferally consecutive blades 14 define, in the gap 11, together with the stator 7, with the rotor 10, with a first closing flange 16 and with a second closing flange, which is not shown, the first closing flange 16 and the second closing flange being provided at opposite ends of the stator 7, a plurality of chambers having a volume that varies over the course of rotation of the rotor 10.

In the stator 7, a supply conduit 17 for delivering pressurised air to the gap 11, primary discharge conduits 18 and secondary discharge conduit 19 for discharging the pressurised air from the gap 11 are obtained.

The primary discharge conduits 18 are obtained in the upper portion 8 of the stator 7, corresponding to the maximum distance between the rotor 10 and the stator 7.

In particular, the primary discharge conduits 18 are in a zone of the pneumatic screwer 1 opposite a further zone of the screwer from which the handle 3 extends.

The supply conduit 17 and the secondary discharge conduit 19 are obtained in further zones of greater thickness of the stator 7 that are arranged symmetrically in relation to a plane passing through a rotation axis of the rotor 10.

This enables the pneumatic screwer 1 to be driven in opposite rotation directions by simply exchanging, by means of a switch 20, 120, disclosed below, the functions of the supply conduit 17 and of the secondary discharge conduit 19.

More precisely, by means of the switch 20, 120 it is possible to deliver into the gap 11 pressurised air alternatively via the supply conduit 17 or the secondary discharge conduit 19, and consequently discharge pressurised air from the gap 11 respectively via the secondary discharge conduit 19 or the supply conduit 17.

The supply conduit 17 and the secondary discharge conduit 19 extend longitudinally in the stator 7 and each comprise a plurality of slits, which are not shown, in flowing communication with the gap 11.

The pneumatic screwer 1 further comprises a cover 33 positioned in a second end portion 34 (FIG. 1) of the pneumatic screwer 1 opposite the first end portion 4.

The cover 33 comprises a seat 35 (FIGS. 8, 9 and 10) for slidably housing the switch 20, 120.

Figure 7:
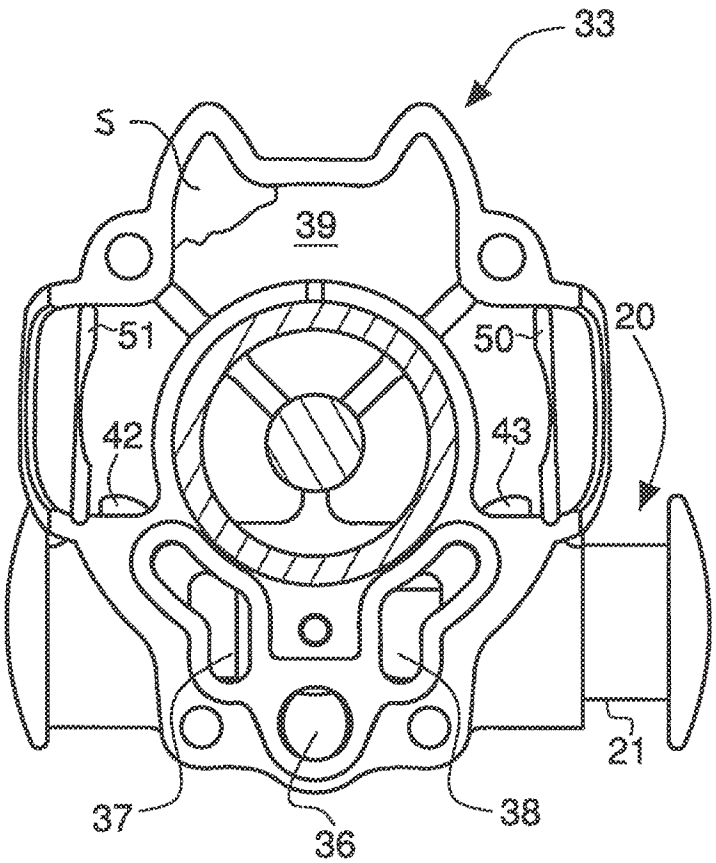
FIG. 7 is a section taken along the plane VII-VII in FIG. 6.

Also, in the cover 33 an expansion chamber 39 (FIG. 7) is obtained that is in flowing communication, not only with the atmosphere, but also with the supply conduit 17, the primary discharge conduits 18 and the secondary discharge conduit 19 for expanding the pressurised air.

In particular, the expansion chamber 39 is positioned on an opposite side of the spindle element 5 with respect to the rotor 10, i.e. in a rear portion of the pneumatic screwer 1.

The expansion chamber 39 comprises a first grid 50 and a second grid 51 provided respectively with first openings 44 and with second openings 45 in flowing communication with the atmosphere.

The first openings 44 and the second openings 45 enable the pressurised air coming from the gap 11 to be discharged into the atmosphere.

The first openings 44 and the second openings 45 are positioned laterally with respect to the handle 3 of the pneumatic screwer 1 and are mutually opposite.

In an embodiment of the invention that is not shown, only the first grid 50 is provided, whereas the second grid 51 is replaced by a closing element. In this manner, the pressurised air, by exiting only from the first openings 44, favours use by a left-handed operator.

In another embodiment of the invention that is not shown, only the second grid 51 is provided, whereas the first grid 50 is replaced by a closing element. In this manner, the pressurised air, by exiting only from the second openings 45, favours use by a right-handed operator.

In another further embodiment of the invention that is not shown, with the first grid 50 and with the second grid 51 respective door elements are associated that are drivable independently between a first position in which they close the first openings 44 and/or the second openings 45 and a second position in which they leave the first openings 44 and/or the second openings 45 open.

In this manner, the pneumatic screwer 1 becomes particularly flexible, inasmuch as, by acting on the door elements opportunely, it can easily be used by both a right-handed and by a left-handed operator.

Also, the expansion chamber 39 is shaped such as to be above to house a silencer, which is not shown, which is arranged for reducing the noise of the pneumatic screwer.

In the cover 33 a delivery conduit 36 for delivering pressurised air to the gap 11, a first distributing channel 37 and a second distributing channel 38 are further obtained. The first distributing channel 37 and the second distributing channel 38 are connectable in flowing communication with the expansion chamber 39 by respectively a hole 42 and a further hole 43.

Figure 4:
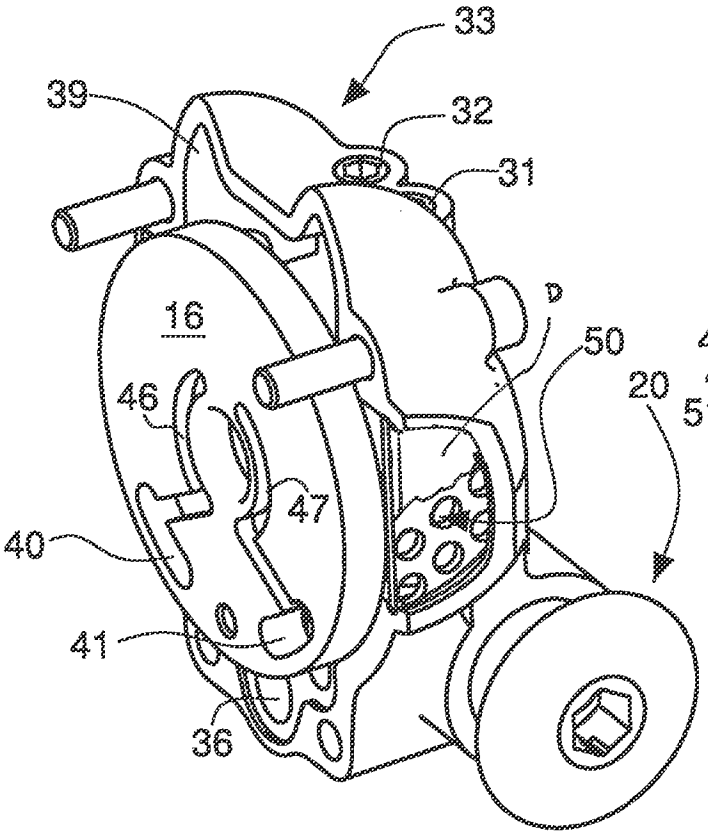

The aforesaid first closing flange 16 (FIG. 4) comprises a first passage 40 to put the first distributing channel 37 in flowing communication with the supply conduit 17 and a second passage 41 to put the second distributing channel 38 in flowing communication with the secondary discharge conduit 19.

Also, in the first closing flange 16 a first groove 46 is obtained that is connected to the supply conduit 17 and arranged for making a certain quantity of pressurised air penetrate inside the seats 13, inducing the blades 14 to exit from the seats 13, in such a manner that the ends 15 of the blades 14 are maintained in contact with the internal wall of the stator 7 for preventing leaks of air between the chambers In the first closing flange 16 a second groove 47 is further obtained that is connected to the secondary discharge conduit 19 and is arranged for enabling the pressurised air to exit from the seats 13, such as to enable the blades 14 to move from the extended to the compact position.

The functions of the first groove 46 and of the second groove alternate according to the screwing direction of the pneumatic screwer 1.

Figure 2:
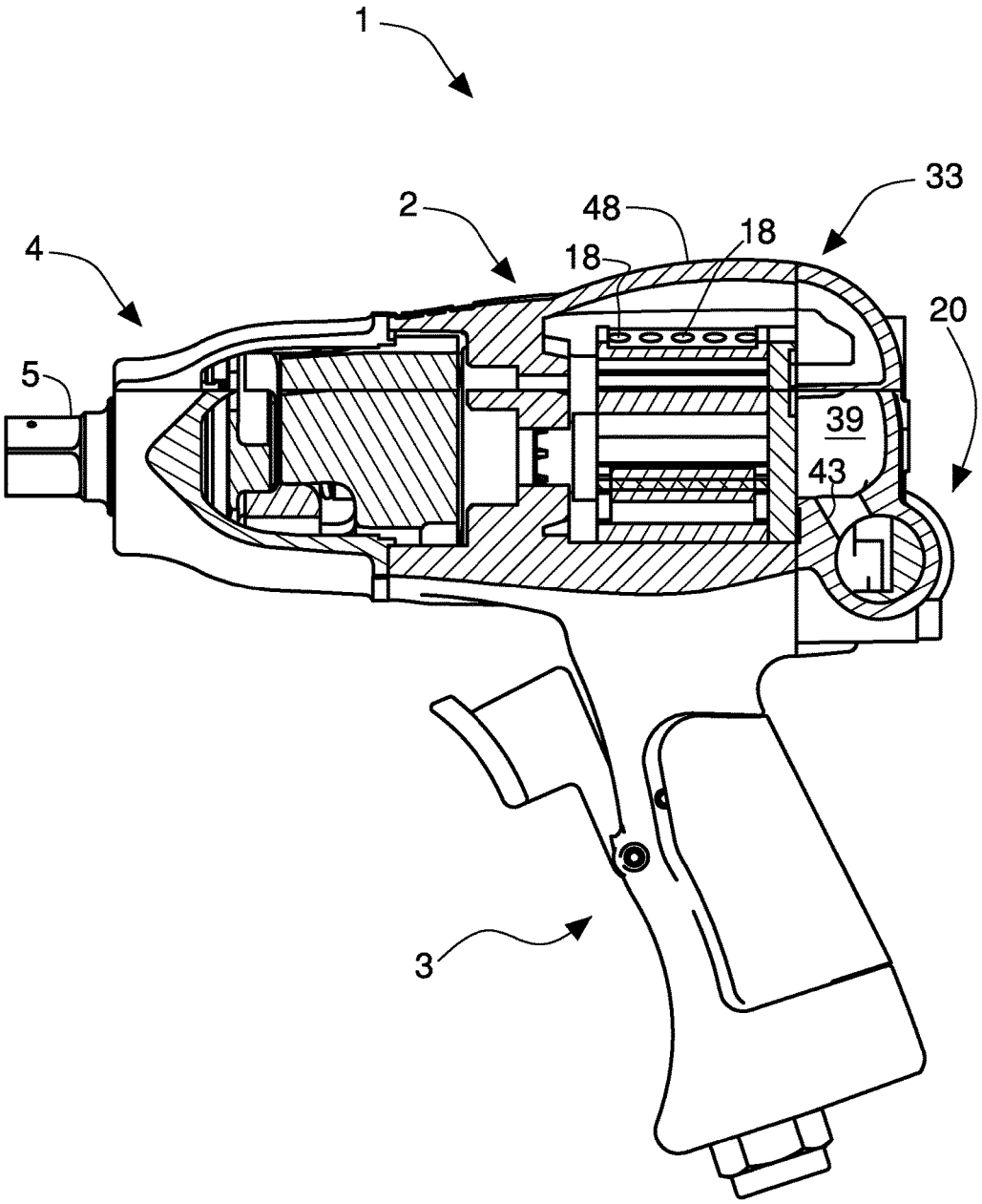
FIG. 2 is a partially sectioned side view of the screwer in FIG. 1.

The pneumatic screwer 1 further comprises a manifold 48 (FIGS. 1 and 2) facing the primary discharge conduits 18 and arranged for expanding, partially, the pressurised air coming from the primary discharge conduits 18 and conveying the pressurised air towards the expansion chamber 39.

The manifold 48 comprises a first protrusion 55 and a second protrusion 56, internally provided respectively with a first cavity and with a second cavity, which are not shown, arranged for expanding, partially, the pressurised air and for conveying the pressurised air in a more effective manner towards the expansion chamber 39.

The aforesaid primary discharge conduits 18 face the first cavity if the pneumatic screwer 1 unscrews anticlockwise, this provides the pneumatic screwer 1 with greater power for this anticlockwise unscrewing.

In this configuration, the primary discharge conduits 18 are tilted by an angle of about 20° with respect to a vertical plane passing through the handle 3.

In use, by rotating the stator 7 opportunely, it is possible to position the primary discharge conduits 18 in such a manner that they face the second cavity in such a manner as to provide the pneumatic screwer 1 with greater power in the event of clockwise unscrewing.

Also in this configuration, which is symmetric with respect to the preceding configuration, the primary discharge conduits 18 are tilted by an angle of about 20° with respect to a vertical plane passing through the handle 3.

In order to move from one configuration to the next, it is sufficient to rotate the stator 7 by about 180° around a vertical axis.

Figure 9:
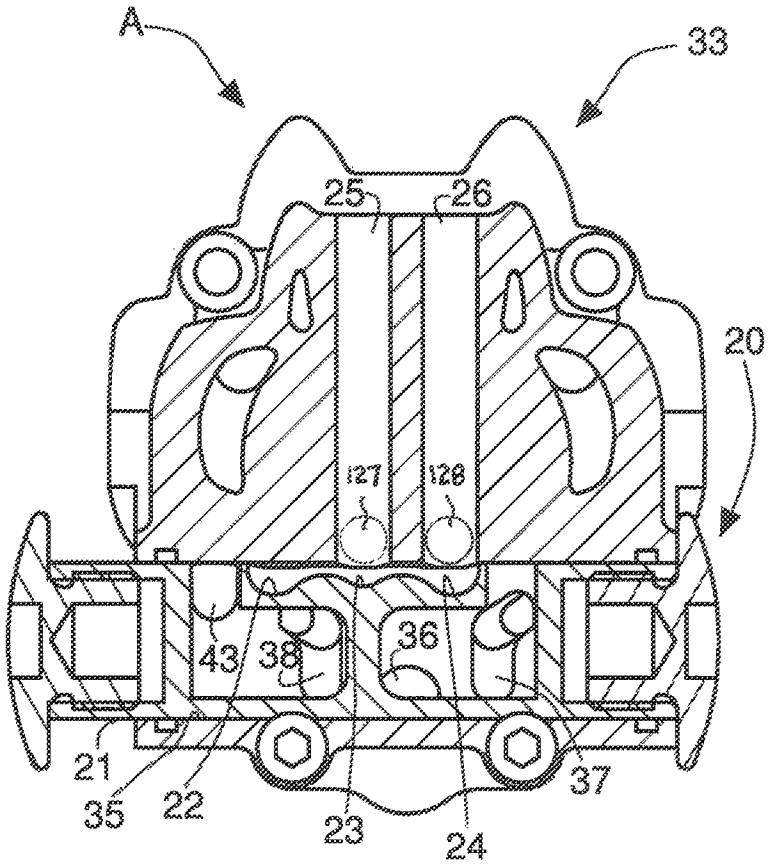
FIG. 9 is a section like that in FIG. 8 with some details removed.
Figure 8:
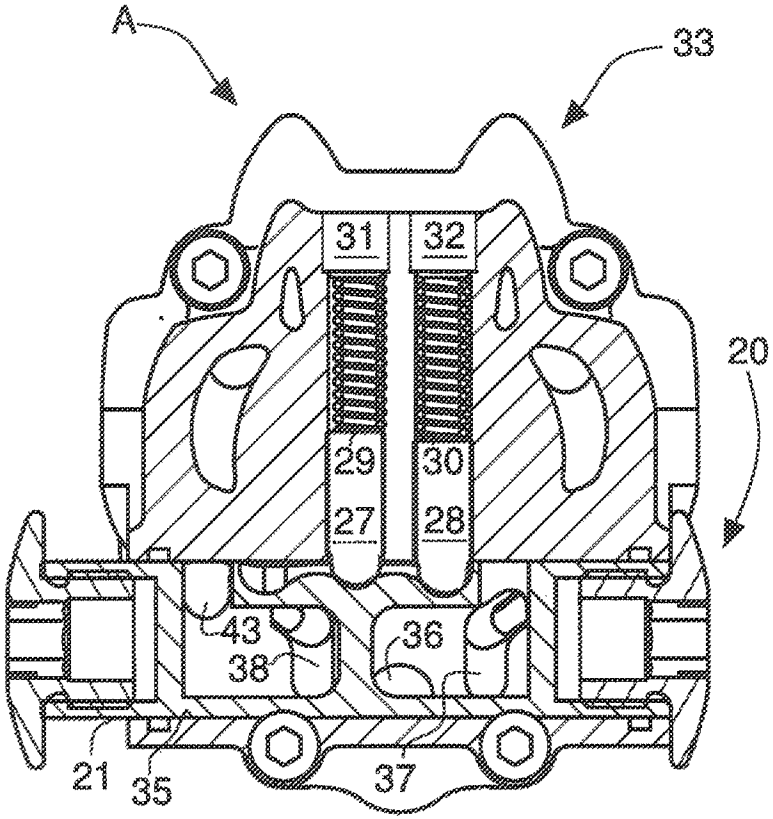
FIG. 8 is a section taken along the plane VIII-VIII in FIG. 6 showing a first embodiment of a switch according to the invention.

With reference to FIGS. 8 and 9 there is shown a first version of the aforesaid switch, indicated with the numeric reference 20.

The switch 20 comprises a cylindrical slider 21 that is slidable in the pneumatic screwer 1 between an operating position in which the pneumatic screwer 1 acts with a screwing direction, and a further operating position in which the pneumatic screwer 1 acts with a further screwing direction.

On the cylindrical slider 21 a first seat 22, a second seat 23 and a third seat 24 are obtained.

The first seat 22, the second seat 23 and the third seat 24 are arranged in sequence, the second seat 23 being interposed between the first seat 22 and the third seat 24.

The first seat 22 and the third seat 24, i.e. the end seats, have the same depth, which is greater than the depth of the second seat 23.

In a version of the invention that is not shown the first seat 22, the second seat 23 and the third seat 24 have different depths.

In a further embodiment of the invention that is not shown, the first seat 22, the second seat 23 and the third seat 24 have the same depths.

Further, the first seat 22, the second seat 23 and the fourth seat 24 have respective concave abutting surfaces, for example curved abutting surfaces.

The pneumatic screwer 1 further comprises a first channel 25 and a second channel 26, which are substantially rectilinear, into which respectively a first locking element 27 and a second locking element 28 are slidable.

The first locking element 27 and the second locking element 28 have a cylindrical shape with one rounded end.

In a version of the invention that is not shown, the first locking element 27 and the second locking element 28 have a spherical shape.

The first locking element 27 and the second locking element 28 are arranged for engaging, in an operating position of the switch 20 corresponding to a desired screwing direction of the pneumatic screwer 1, with a pair of the aforesaid seats 22, 23, 24.

In particular, in a first operating position A of the switch 20, shown in FIG. 8, the first locking element 27 and the second locking element 28 engage respectively with the second seat 23 and with the third seat 24, whereas in a second operating position of the switch 20 that is not shown the first locking element 27 and the second locking element 28 engage respectively with the first seat 22 and with the second seat 23.

Consequently, both in the first operating position A and in the second operating position, the first locking element 27 and the second locking element 28 engage with two of the seats 22, 23, 24, the second seat 23 engaging alternatively with the first locking element 27 or with the second locking element 28.

The first locking element 27 and second locking element 28 are pressed against the seats 22, 23, 24 by respectively a first spring 29 and a second spring 30.

The first spring 29 and the second spring 30 can be adjusted by respectively a first adjusting screw 31 and a second adjusting screw 32.

Also, the stiffness of the first spring 29 and the second spring 30 can differ.

In use, at the start of an operating cycle, the switch 20 is positioned, for example, in the first operating position A.

In the first operating position A, the switch 20 places the delivery conduit 36 in flowing communication with the first distributing channel 37.

Also, in the first operating position A, the switch 20 puts the second distributing channel 38 in flowing communication with the expansion chamber 39 via the further hole 43.

Also, in the first operating position A, the switch 20 separates the first distributing channel 37 from the expansion chamber 39, closing the hole 42. In other words, when the switch 20 is in the first operating position A, the first distributing channel 37 is not in flowing communication with the expansion chamber 39.

The pressurised air, introduced by the delivery conduit 36, passes through the first distributing channel 37, the first passage 40, the first channel 46 and the supply conduit 17, which delivers the pressurised air to the gap 11 inside a chamber that is initially of reduced volume, which is namely positioned near a zone in which the rotor 10 is nearer the stator 7.

Forces that tend to drive the rotor 10 in opposite directions act on the blades 10 that define this chamber.

The prevailing force is the one that acts on the blade 14 that protrudes most from the respective seat 13.

The resultant of the aforesaid forces produces a driving torque on the rotor 10.

Subsequently, a portion of air contained in this chamber, which is already partially expanded, is expelled via the primary discharge conduits 18 which, via the manifold 48, are in flowing communication with the expansion chamber 39, the latter being in flowing communication with the atmosphere.

Still subsequently, following a further rotation of the rotor 10, a remaining portion of air contained inside this chamber is expelled via the secondary discharge conduit 19 and conveyed via the second passage 41, the second channel 47, the second distributing channel 38, and the further hole 43 until it reaches the expansion chamber 39 in flowing communication with the atmosphere.

When it is desired to use the pneumatic screwer 1 with another screwing direction, opposite the preceding one, it is sufficient to act on the switch 20 by positioning the switch 20 in the second operating position.

In the second operating position, the switch 20 puts the delivery conduit 36 in flowing communication with the second distributing channel 38.

Also, in the second operating position, the switch 20 puts the first distributing channel 37 in flowing communication with the expansion chamber 39 via the hole 42.

Also, in the second operating position, the switch 20 separates the second distributing channel 38 from the expansion chamber 39 by closing the further hole 43. In other words, when the switch 20 is in the second operating position, the second distributing channel 38 is not in flowing communication with the expansion chamber 39.

The pressurised air, introduced by the delivery conduit 36, passes through the second distributing channel 38, the second passage 41, the second channel 47 and the secondary discharge conduit 19, which now acts as a supply conduit, that delivers the pressurised air into the gap 11 inside a chamber that is initially of reduced volume, i.e. positioned near a zone in which the rotor 10 is nearer the stator 7.

Forces that tend to drive the rotor 10 in opposite directions act on the blades 10 that define this chamber.

The prevailing force is the one that acts on the blade 14 that protrudes most from the respective seat 13.

The resultant of the aforesaid forces produces a driving torque on the rotor 10 by driving the rotor 10 in an opposite direction than before.

Subsequently, a portion of air contained in this chamber, which has already been partially expanded, is expelled via the primary discharge conduits 18 which, via the manifold 48, are in flowing communication with the expansion chamber 39, the latter being in flowing communication with the atmosphere.

Still subsequently, following a further rotation of the rotor 10, a remaining portion of air contained inside this chamber is expelled via the supply conduit 17, which now acts as secondary discharge conduit, and is conveyed via the first passage 40, the first channel 46, the first distributing channel 37, and the hole 42 until it reaches the expansion chamber 39 in flowing communication with the atmosphere.

Figure 11:
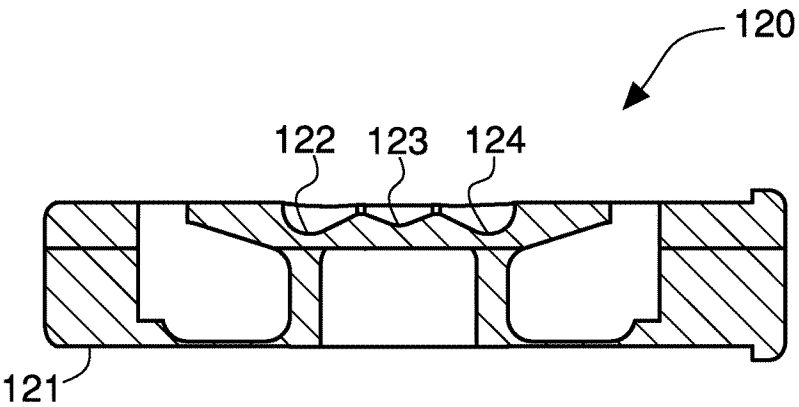
FIG. 11 is a longitudinal section of the second embodiment of the switch according to the invention.
Figure 10:
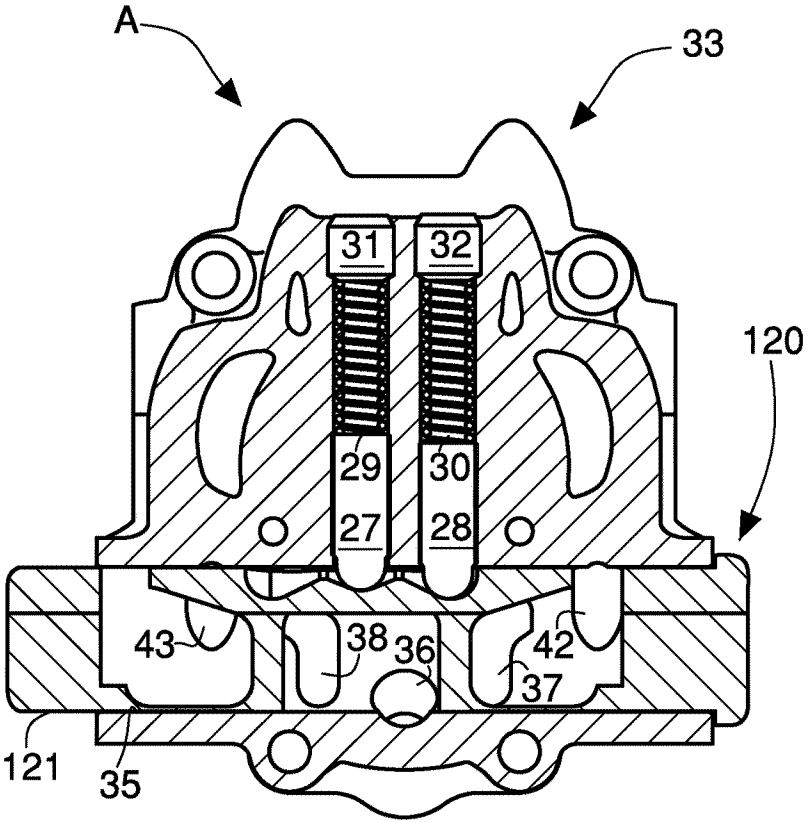
FIG. 10 is a section like that in FIG. 8 showing a second embodiment of a switch according to the invention.

With reference to FIGS. 10 and 11, there is shown a second version of the aforesaid switch, indicated by the numeric reference 120.

The switch 120 comprises a cylindrical slider 121 that is slidable in the pneumatic screwer 1 between an operating position in which the pneumatic screwer 1 acts with a screwing direction, and a further operating position in which the pneumatic screwer 1 acts with a further screwing direction.

On the cylindrical slider 121 a first seat 122, a second seat 123 and a third seat 124 are obtained.

The first seat 122, the second seat 123 and the third seat 124 are arranged in sequence, the second seat 123 being interposed between the first seat 122 and the third seat 124. The first seat 122 and the third seat 124, i.e. the end seats, have the same depth, which is greater than the depth of the second seat 123.

In a version of the invention that is not shown, the first seat 122, the second seat 123 and the third seat 124 have different depths.

In a further embodiment of the invention that is not shown, the first seat 122, the second seat 123 and the third seat 124 have the same depth.

Also, the first seat 122, the second seat 123 and the fourth seat 124 have respective concave, for example curved, abutting surfaces.

Also the switch 120 is movable between a first operating position A, shown in FIG. 10, and a second operating position, which is not shown.

In particular, in the first operating position A of the switch 120, the first locking element 27 and the second locking element 28 engage respectively with the second seat 123 and with the third seat 124, whereas in the second operating position of the switch 120, which is not shown, the first locking element 27 and the second locking element 28 engage respectively with the first seat 122 and with the second seat 123.

Consequently, both in the first operating position A and in the second operating position, the first locking element 27 and the second locking element 28 engage with two of the seats 122, 123, 124, the second seat 123 engaging alternatively with the first locking element 27 or with the second locking element 28.

The first locking element 27 and the second locking element 28 are pressed against the seats 122, 123, 124 by respectively the first spring 29 and the second spring 30.

The first spring 29 and the second spring 30 can be adjusted by respectively the first adjusting screw 31 and the second adjusting screw 32.

Also, the stiffness of the first spring 29 and of the second spring 30 can differ.

In use, at the start of an operating cycle, the switch 120 is positioned, for example, in the first operating position A.

In the first operating position A, the switch 120 puts the delivery conduit 36 in flowing communication with the second distributing channel 38.

Also, in the first operating position A, the switch 120 puts the first distributing channel 37 in flowing communication with the expansion chamber 39 via the hole 42.

Also, in the first operating position A, the switch 120 separates the second distributing channel 38 from the expansion chamber 39 by closing the further hole 43. In other words, when the switch 120 is in the first operating position A, the second distributing channel 38 is not in flowing communication with the expansion chamber 39.

The pressurised air, introduced by the delivery conduit 36, passes through the second distributing channel 38, the second passage 41, the second channel 47 and the secondary discharge conduit 19, which now acts as supply conduit, that delivers the pressurised air to the gap 11 inside a chamber of initially reduced volume, i.e. positioned near a zone in which the rotor 10 is nearer the stator 7.

On the blades 14 that define this chamber, forces act that tend to drive the rotor 10 in opposite directions.

The prevailing force is the one that acts on the blade 14 that protrudes most from the respective seat 13.

The resultant of the aforesaid forces produces a driving torque on the rotor 10 that rotates the rotor 10.

Subsequently, a portion of air contained in this chamber, which has already been partially expanded, is expelled via the primary discharge conduits 18, which, via the manifold 48, are in flowing communication with the expansion chamber 39, the latter being in flowing communication with the atmosphere.

Also subsequently, following a further rotation of the rotor 10, a remaining portion of air contained inside this chamber is expelled via the supply conduit 17, which now acts as secondary discharge conduit, and is conveyed via the first passage 40, the first channel 46, the first distributing channel 37, and the hole 42 until it reaches the expansion chamber 39 in flowing communication with the atmosphere.

When it is desired to use the pneumatic screwer 1 with another screwing direction, opposite the previous one, it is sufficient to act on the switch 120 by positioning the switch in the second operating position.

In the second operating position, the switch 120 puts the delivery conduit 36 in flowing communication with the first distributing channel 37.

Also, in the second operating position, the switch 120 puts the second distributing channel 38 in flowing communication with the expansion chamber 39 via the further hole 43.

Also, in the second operating position, the switch 120 separates the first distributing channel 37 from the expansion chamber 39 by closing the hole 42. In other words, when the switch 20 is in the second operating position, the first distributing channel 37 is not in flowing communication with the expansion chamber 39.

The pressurised air, introduced by the delivery conduit 36, passes through the first distributing channel 37, the first passage 40, the first channel 46 and the supply conduit 17 which delivers the pressurised air into the gap 11 inside a chamber of initially reduced volume, i.e. positioned near a zone in which the rotor 10 is nearer the stator 7.

Forces that tend to drive the rotor 10 in opposite directions act on the blades 10 that define this chamber.

The prevailing force is the one that acts on the blade 14 that protrude most from the respective seat 13.

The resultant of the aforesaid forces produces a driving torque on the rotor 10.

Subsequently, a portion of air contained in this chamber, which has already been partially expanded, is expelled via the primary discharge conduits 18 which, via the manifold 48, are in flowing communication with the expansion chamber 39, the latter being in flowing communication with the atmosphere.

Also subsequently, following a further rotation of the rotor 10, a remaining portion of air contained inside this chamber is expelled via the secondary discharge conduit 19 and is conveyed via the second passage 41, the second channel 47, the second distributing channel 38, the further hole 43 until it reaches the expansion chamber 39 in flowing communication with the atmosphere.

It should be noted how, for the same operating position, the switch 20 and the switch 120 induce opposite screwing directions to the pneumatic screwer 1.

It should be noted that the pneumatic screwer 1 is more efficient than known screwers.

In fact, the primary discharge conduits 18 and the secondary discharge conduit 19 are in flowing communication with the expansion chamber 39, which is positioned on an opposite side of the spindle element 5 with respect to the rotor 10 and is in flowing communication with the atmosphere.

This enables the pressurised air to reduce the path that it needs to travel to expand completely, as it no longer has to travel over the entire handle 3 of the pneumatic screwer 1, which enables the performance of the pneumatic screwer 1 according to the invention to be increased.

Also, it should be noted that the pneumatic screwer 1 according to the invention is more comfortable for the operator to use.

In fact, the pressurised air is expelled into the atmosphere via the first grid 50 and/or the second grid 51 positioned laterally with respect to the handle 3, this enabling it to be prevented that jets of pressurised air hit the operator.

It should be further noted how, in use, the primary discharge conduits 18 and the secondary discharge conduit 19, or the supply conduit 17 when it acts as a discharge conduit, define paths that are different and separate from one another for the air exiting from the gap 11, these paths both leading into the expansion chamber 39, in which the air can mix and exit into the atmosphere.

Also, it should be noted that the switch 20, 120 according to the invention is more reliable and manoeuvrable than known switches.

In fact, the results of experiments have shown that the first locking element 27 and the second locking element 28 engaging, in the operating position, with two of the three seats 22, 23, 24, or 122, 123, 124, enable the switch 20, 120 to maintain effectively the operating position, at the same time ensuring the easy manoeuvrability of the operating position.

The invention claimed is:

1. A pneumatic screwing device, comprising a main body;

a spindle for rotatably supporting a screwing tool, said spindle projecting from a first end portion of said main body;

a rotor that is pneumatically rotatable for rotating said spindle;

a stator for housing said rotor, a gap being defined between said rotor and said stator for receiving pressurized air;

a supply conduit element arranged in said stator for delivering said pressurized air into said gap;

a discharge conduit arranged in said stator for discharging said pressurized air from said gap;

a cover positioned in a second end portion of said main body opposite said first end portion;

a handle connected with said second end portion of said main body;

a switch for switching a screwing direction of said screwing device, said switch comprising a cylindrical slider which is slidable within said main body between an operating position in which said screwing device operates in a first screwing direction and a further operating position in which said screwing device operates in a further screwing direction, said slider containing three spaced seats arranged for engaging with a locking device slidably associated with said main body for maintaining said switch in said operating position corresponding to a desired screwing direction of said screwing device, wherein said three seats are arranged in sequence along said cylindrical slider and said locking device engages, in each operating position, two of said three seats; and said cover containing an expansion chamber positioned on an opposite side of said spindle with respect to said rotor and in flowing communication with said discharge conduit for expanding said pressurized air, at least one first opening arranged on one side of said handle, and at least one second opening arranged on a side of said handle opposite said first opening, said at least one first and second openings affording flowing communication between said expansion chamber and the atmosphere.

2. A screwing device according to claim 1, wherein said discharge conduit comprises a first discharge conduit obtained in an upper portion of said stator and a second discharge conduit obtained in a lower portion of said stator.

3. A screwing device according to claim 2, wherein said main body includes a manifold facing said first discharge conduit and arranged for at least partially expanding said pressurized air and for conveying said pressurized air from said first discharge conduit towards said expansion chamber.

4. A screwing device according to claim 3, wherein said manifold comprises a pair of internally hollow protrusions.

5. A switch for switching a screwing direction of a pneumatic screwing device, comprising a cylindrical slider which is slidable in a body of the screwing device between an operating position in which the screwing device operates in a first screwing direction and a further operating position in which the screwing devices operates in a further screwing direction, said cylindrical slider containing three seats for engaging with a locking device slidably associated with the body of said screwing device for maintaining said switch in the operating position corresponding to a desired screwing direction of said screwing device, wherein said three seats are arranged in sequence along said cylindrical slider, said locking arrangement engaging, in each operating position, two of said three seats.

6. A switch according to claim 5, wherein said three seats have different depths.

7. A switch according to claim 5, wherein two of said three seats have the same depth which is greater than the depth of the remaining seat.

8. A switch according to claim 7, wherein said three seats are arranged with said remaining seat interposed between the other two seats, said locking device engaging, in each operating position, said remaining seat and one of the other two seats.

9. A switch according to claim 5, wherein said three seats have concave abutting surfaces, respectively.

10. A switch according to claim 5, wherein said locking device is pressed against said seats by an elastic device.

11. A switch according to claim 10, wherein said elastic device comprises a first spring and a second spring.

12. A switch according to claim 11, wherein said first spring and said second spring have a different stiffness.

13. A pneumatic screwing device comprising a switch as claimed in claim 5.

14. A switch for switching a screwing direction of a pneumatic screwing device, comprising a cylindrical slider which is slidable in a body of the screwing device between a first operating position in which the screwing device is operated in a first screwing direction and a second operating position in which the screwing device is operated in a second screwing direction, said cylindrical slider containing first, second and third seats arranged in sequence along said cylindrical slider; and a locking device which is slidable in the body of the screwing device for maintaining the switch in an operating position, said locking device engaging said first and second seats to retain said cylindrical slider in one of said first and second operating positions and said locking device engaging said second and third seats to retain said cylindrical slider on another of said first and second operating positions.

* * * * *